United States Patent [19]

Perkins

[11] 3,958,636

[45] May 25, 1976

[54] PRODUCTION OF BITUMEN FROM A TAR SAND FORMATION

[75] Inventor: Thomas K. Perkins, Dallas, Tex.

[73] Assignee: Atlantic Richfield Company, Los Angeles, Calif.

[22] Filed: Jan. 23, 1975

[21] Appl. No.: 543,458

[52] U.S. Cl. ..... 166/248; 166/272

[51] Int. Cl.[2] ..... E21B 43/22; E21B 43/24

[58] Field of Search ..... 166/248, 272, 60, 302, 166/303, 268

[56] References Cited

UNITED STATES PATENTS

| | | | |
|---|---|---|---|
| 2,780,450 | 2/1957 | Ljungstrom | 166/60 X |
| 2,801,090 | 7/1957 | Hoyer et al. | 166/60 X |
| 3,103,975 | 9/1963 | Hanson | 166/248 X |
| 3,106,244 | 10/1963 | Parker | 166/248 |
| 3,507,330 | 4/1970 | Gill | 166/248 |
| 3,547,192 | 12/1970 | Claridge et al. | 166/248 |
| 3,547,193 | 12/1970 | Gill | 166/248 |
| 3,605,888 | 9/1971 | Crowson et al. | 166/248 |

*Primary Examiner*—Stephen J. Novosad
*Attorney, Agent, or Firm*—Ronnie D. Wilson

[57] ABSTRACT

A method of producing bitumen from a subterranean tar sand formation while heating the formation via electrical conduction between a plurality of wells completed therein characterized by a plurality of steps. First, a high back pressure is maintained on the wells. Next, an immiscible fluid is injected into the formation through one of the wells. Thereafter, the bitumen is produced through one of the wells.

9 Claims, 1 Drawing Figure

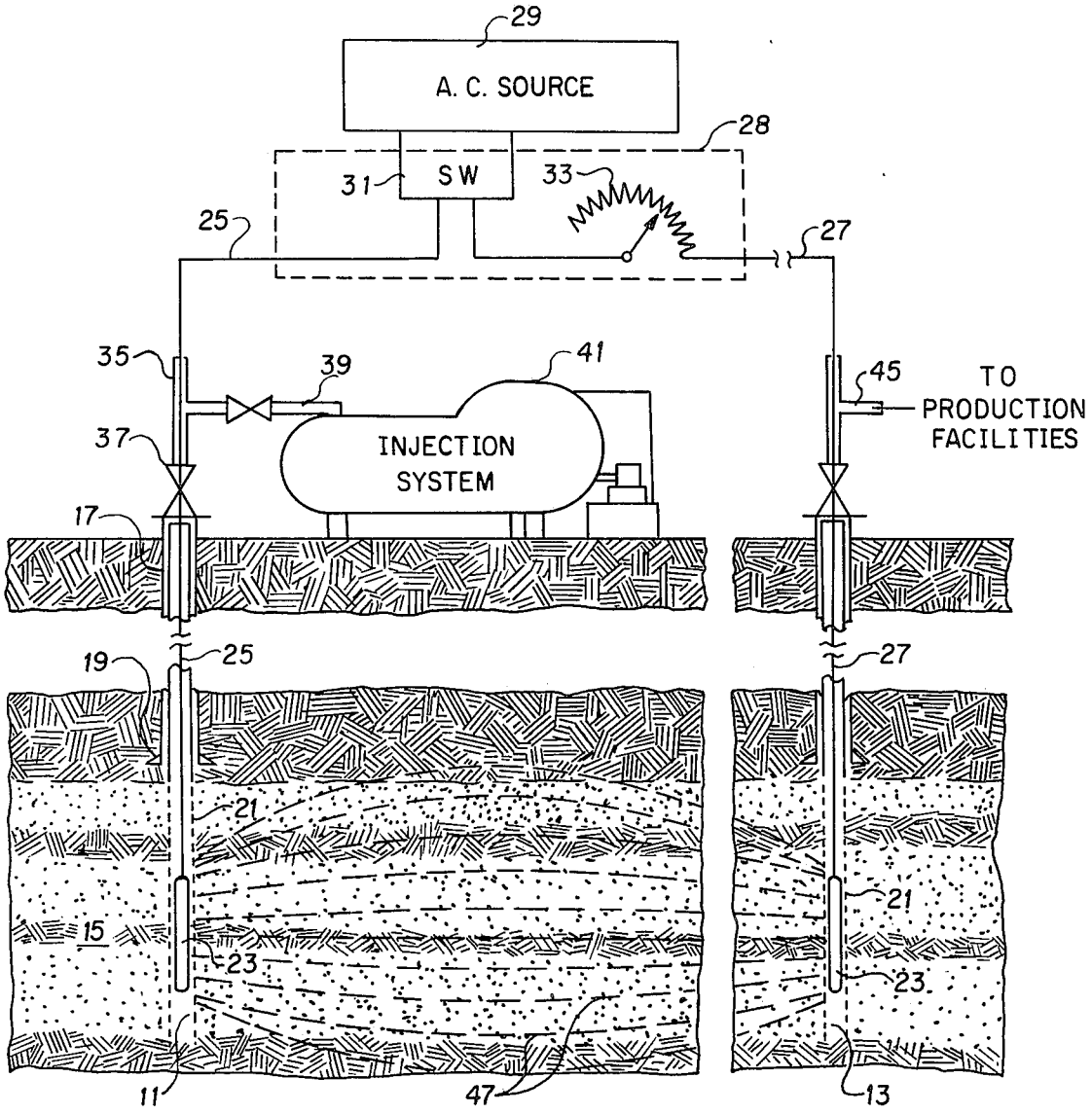
29
A. C. SOURCE
28
31
SW
33
25
27
35
39
41
45
TO
PRODUCTION
FACILITIES
37
INJECTION
SYSTEM
17
19
25
27
21
21
15
23
23
11
47
13

PRODUCTION OF BITUMEN FROM A TAR SAND FORMATION

This invention relates to a method of producing bitumen from a subterranean tar sand formation in which the bitumen is in a nonflowable, highly viscous state. More particularly, this invention relates to a method of recovering bitumen from a subterranean tar sand formation while electrically heating same.

Large deposits of bitumen in surface tar sands and subterranean tar sand formations have long been known to exist in several nations of the world. These tar sands are discussed in detail in Kirk-Othmer ENCYCLOPEDIA OF CHEMICAL TECHNOLOGY, Second Edition, Anthony Standen, Editor, Interscience Publishers, New York, 1969, Vol. 19, pages 682–732. That discussion points out that the bitumen in the tar sand formations has been carelessly referred to by a variety of names, such as, "tar", "hydrocarbons" and "crude oil", but that this is a misnomer, since the bitumen contains nitrogenous compounds, as well as other constituents not usually found in the named products. In fact, that discussion goes on to emphasize that the recovery of tar from the tar sand has proved a fertile field for inventors, since almost all of the methods of recovering conventional hydrocarbons are inoperable in the tar sands because of the problem of achieving mobility of the highly viscous bitumen. All of the bitumen found in tar sands has a viscosity greater than at least 5,000 centipoises and the majority of the bitumen has a viscosity in the range of 500,000–5,000,000 centipoises at 50° Fahrenheit. The bitumen has a density greater than water at 60°F, with a specific gravity equivalent to about 6°–10°API.

The bitumens are so different from crude oil that, not only are the production problems different, but also the upgrading and refining of the bitumen after being produced presents problems that are unique. For example, the bitumen has to be upgraded by partial coking, by delayed coking with catalytic hydrodesulfurization of the coke or distillate, or by direct catalytic hydrovisbreaking to be salable.

The geology of the subterranean tar sand formations is described in detail at page 688 of the above referenced Kirk-Othmer Encyclopedia. This discussion indicates that about only 10 percent of the known bitumen is recoverable by conventional mining techniques. The subterranean tar sand formation comprises about 99 percent quartz sand and clays. The sand particles are coated with connate water envelopes. The bitumen exists in the interstices intermediate the water enveloped sand grains. Ordinarily, the tar sand formation is underlaid and overlaid by impermeable shales having different physical properties from the tar sand.

A large number of different techniques have been tried in attempting to feasibly recover the bitumen from the tar sand reservoirs. A number of these earlier attempts and patent references and the like are catalogued in a comprehensive bibliography entitled "preliminary Report 65–3, Athabasca Oil Sands Bibliography (1789–1964)", M. A. Carrigy, comp., Research Council of Alberta, Alberta, Canada, 1965. The large number of recovery processes have included a variety of flooding methods, such as fire floods; exotic recovery schemes, such as emulsion steam drives; and even atomic explosions and the like. Despite the large number of processes tried, the only commercial processes are those employing surface mining. Yet, surface mining of tar sand having a 10 percent saturation requires handling about two tons of tar sand per barrel of bitumen recovered. In the commercial processes employing surface mining, the bitumen is recovered by steam or hot water extraction and upgraded by processes comprising: (1) thermal cracking and hydrotreating or (2) coking and hydrotreating. Since the price of crude oil has been driven upward by the energy shortage in some of the more industrialized nations, such as the United States, there are pilot operations being conducted at present to see if some recovery scheme effecting in situ separation of the bitumen from the tar sand can be made economically feasible. The pilot operations have employed a wide variety of different techniques to try to preheat the bitumen to attain a mobility sufficient to produce it from the tar sand formation. For example, it has been known to inject hot water or steam to heat soak around a given well and thereafter try to produce the heated and "molten" bitumen, or bitumen of reduced viscosity, from the same well.

To date, however, insofar as I am aware, none of the processes have been proved economically feasible. Thus, it can be seen that the processes that have achieved success in the recovering of the bitumen from the tar sand formations are vastly different from those employed in recovering conventional crude oil; and none of the conventional oil recovery methods or methods attempting separation of the bitumen from the tar sand in situ has proved commercially successful.

Accordingly, it is an object of this invention to provide a method of recovering bitumen from a subterranean tar sand formation by separating the bitumen from the sand in situ, without requiring handling of the large mass of tar sand.

It is another object of this invention to provide a method of recovering bitumen from a subterranean tar sand formation such that it can be separated from the tar sand formation in situ and then producing the mobilized bitumen from one or more wells while heating is continued.

These and other objects will become apparent from the descriptive matter hereinafter, particularly when taken in conjunction with the drawings.

In accordance with this invention, bitumen is produced from a subterranean tar sand formation while heating said formation via electrical conduction between a plurality of wells completed therein by the following multi-step process. First, a high back pressure is maintained on the wells. Next, a fluid which is immiscible with the bitumen is injected into the tar sand formation through at least one of the wells. Thereafter, the bitumen is produced from at least one of the wells.

The steps of maintaining a high back pressure and injecting of the fluid may be employed once only or simultaneously as desired to attain the desired production rate during electrical heating of the formation.

The FIGURE is a side elevational view, partly schematic and partly in section, illustrating one simplified embodiment of this invention.

Referring to the FIGURE, a plurality of wells 11 and 13 have been drilled into a completed within the subterranean tar sand formation 15. Each of the wells 11 and 13 have been completed so they may be operated as either injection or production wells. Specifically, the wells have a string of casing 17 that is inserted in the drilled bore hole and cemented in place with the usual foot 19. A perforate conduit 21 extends into the subterranean tar sand formation 15 adjacent the periphery of the wellbore that was drilled thereinto. Preferably, the casing 17 includes a lower electrically insulated conduit for constraining the electrical current flow to the subterranean tar sand formation as much as practical. The perforate conduit 21 may be casing having the same or a different diameter from casing 19, or it may be large diameter tubing inserted through the casing 19. As illustrated, the perforate conduit 21 comprises a separate string of conduit extended from the surface for better preserving the heat content of an injected immiscible fluid.

Each of the wells 11 and 13 has an electrode 23. The respective electrodes 23 are connected via electrical conductors 25 and 27 with surface equipment 28 and a source of electrical current, illustrated as alternating current (A.C.) source 29. The electrical conductors 25 and 27 are insulated between the electrodes 23 and the surface equipment. The surface equipment 28 includes suitable controls that are employed to effect the predetermined current flow. For example, a switch (SW) 31 and voltage control means, such as rheostat 33, are illustrated for controlling the duration and magnitude of the current flow between the electrodes 23 in the wells 11 and 13 by way of the subterranean tar sand formation 15. It is preferred that the alternating current source 29 be adjusted to provide the correct voltage for effecting the current flow through the subterranean tar sand formation 15 without requiring much power loss in surface control equipment, exemplified by rheostat 33. The respective electrical conductors 25 and 27 are emplaced in their respective wells 11 and 13 with conventional means. As illustrated, they are run through lubricators 35 in order to allow alternate or simultaneous heating, and injection and production, without having to alter the surface accessories, such as changing the configuration of the well heat 37, with its valves and the like.

As illustrated, the well 11 is connected with an immiscible fluid injection system by way of suitable insulated surface conduit 39. The illustrated fluid injection system comprises a storage tank for injecting fluid which has a specific resistivity less than that of the connate water in place. The injection system 41 is constructed and operated in accordance with conventional engineering technology that does not, per se, form part of this invention and is well known and is not described in detail herein. The conventional injection system technology is contained in a number of printed publications which are incorporated herein by reference for details.

The perforate conduit 21 in well 13 is connected to surface production facilities by way of a second surface conduit 45. The production facilities are those normally employed for handling normally viscous crude oils and are not shown, since they are well known in the art. The production facilities include such conventional apparatus as heater treaters, separators, and heated storage tanks, as well as the requisite pumping and flow facilities for handling the bitumen. The production facilities also are connected with suitable conventional bitumen processing facilities (also not shown), such as are employed in the conventional processing of the bitumen after it is recovered from the tar sand formation by surface mining techniques, or otherwise. Since these production and processing facilities do not, per se, form a part of this invention, they are not described in detail herein.

In operation, the wells 11 and 13 are completed in the tar sand formation 15 in accordance with conventional technology. Specifically, bore holes are drilled, at the desired distance and patterning, from the surface into the subterranean tar sand formation 15. Thereafter, the casing 17 is set into the formation to the desired depth. As illustrated, the casing 17 may comprise a surface string that is cemented into place immediately above the tar sand formation. Thereafter, a second string of casing, including an insulated perforate conduit 21, is emplaced in the respective bore holes and completed in accordance with the desired construction. For example, a perforate conduit 21 may have its foot cemented in place, or it may be installed with a gravel pack or the like to allow for expansion and contraction and still secure the desired injectivity and productivity.

In any event, the electrodes are thereafter placed in respective wells. For example, the tar sand formation may be from 100 to 300 feet thick and the respective electrodes 23 may be from 50 to 100 feet or more in length. The electrodes 23 are continuously conductive along their length and are connected with the respective electrical conductors 25 and 27 by conventional techniques. For example, the electrodes 23 may be of copper based alloy and may be connected with copper based conductors 25 and 27 by suitable copper based electrical connectors. Thereafter, the alternating current source 29 is connected with the conductors 25 and 27 by way of the surface control equipment, illustrated simply as switch 31 and rheostat 33. If the desired current densities are obtainable without the use of the rheostat, it is set on the zero resistance position to obtain the desired current flow between the wells.

Immediately, upon beginning heating, a high back pressure is held on the wells utilized for the injection of the immiscible fluid. The pressure held on the injection wells should be in the range of from about 100 to about 2000 psi. However, the pressure should be kept below that which is sufficient to lift the overburden, ordinarily referred to as the fracturing pressure.

The fracturing pressure not only limits the injection pressure but, as indicated hereinbefore, also limits the pressure and temperature for maintaining the water envelopes on the sand grains for conductivity. It is recognized that the pressure that will effect fracturing with a given overburden depth may be determined in accordance with conventional petroleum engineering technology. A safe and over-simplified figure may be taken as one-half pound per square inch (psi) for each foot of overburden depth. Thus, an overburden depth of 1,200 feet will safely sustain an injection pressure, or a pressure necessary to retain saturation around a well, of 600 psi. Ordinarily, a somewhat higher pressure may be employed once the geology of a given overburden site is properly investigated. For example, if there is 1,000 feet of overburden on the tar sand formation 15, the injection pressure will probably not exceed 500 pounds per square inch.

Since there will be a high current density immediately adjacent each of the electrodes 23, the temperature will tend to increase more rapidly in this area. Accordingly, it is desirable to inject the immiscible fluid around each of the wells in order to keep the conductivity high in this region. It is preferable to inject an immiscible fluid having a density greater than that of the in place bitumen and water in order to obviate the necessity of repeated injections of fluid. The current flow through the tar sand formation to heat the tar sand formation 15 and the bitumen therewithin depends on the connate water envelopes surrounding the sand grains. Accordingly, the temperature in the regions of highest current densities, for example, in the regions immediately about and adjoining the wells, should not be so high as to cause evaporation of the water envelopes at the pressure that is sustainable by the overburden. Expressed otherwise, the predetermined electrical current should be maintained low enough to prevent drying of the tar sand formation 15 around the wells 11 and 13.

The electrical current will flow primarily through the tar sand formation, although some of the electrical energy will flow through the bitumen-impermeable shales, as illustrated in the dashed lines 47. The voltage and current flow are adjusted to effect the desired gradual increase in temperature of the tar sand formation 15 and the bitumen therein without overheating locally at the points of greatest current density, as indicated hereinbefore. For example, the current may run from a few hundred to 1,000 or more amperes at the voltage drop between the electrodes 23 in the wells 11 and 13. This voltage drop may run from a few hundred volts to as much as 5,000 or more volts.

The heating is continued along with the production of mobilized tar resulting from the thermal expansion of the fluid and vaporization of water. There will be temperature variations throughout the formation. Even in averaged temperatures, there is variance because of the distance between wells and the differences in current densities. The larger cross-sectional areas near the midplane between the wells have less current density and, hence, less temperature increase. Also, there are variations because of the heterogeneities in the tar sand formation 15. In any given tar sand formation 15, the period of time prior to going to subsequent means of production may be determined empirically, if desired, to check the theoretical, or projected, calculations of the temperature. The empirical determinations resulting from a given test pattern can then be extrapolated to larger production patterns in accordance with conventional technology. Since the tar sand formation and the bitumen therewithin do not behave in conventional manner, the empirical approach is preferred over initiating a commercial venture without a pilot and test pattern in a given tar sand formation.

As the bitumen is heated, it begins to have a greater mobility in the tar sand formation 15. Once the yield point of the bitumen is reached in the tar sand formation, or at least the temperature at which plastic flow begins at the pressure that can be imposed at the injection well, as described hereinafter, mobility begins to make feasible in situ separation.

The complicated and interrelated events that determine mobility and, hence, productivity, require that the electrical heating prior to commencing further production methods such as steam drive must be long enough to get an overall mobility of the bitumen that is high enough to sustain a minimum flow through from the one or more injection wells to the one or more production wells. If the predicted temperature at the midpoint intermediate the two wells is inadequate to sustain the minimum flow through, the electrical heating will have to be continued. Thus, empirically, if mobility of the bitumen will sustain a minimum throughput of at least 30 barrels per day, the drive methods are economically preferable over the electrical heating and the injection of driving fluids is begun without the electrical heating.

It is preferable to employ a more scientific approach to empirically verify the degree of heating of the tar sand formation. The preferable approach is to drill a small bore hole from the surface of the earth into the tar sand formation midway between the injection and production wells and measure a temperature profile vertically through the tar sand formation 15. Once the temperature in this area has attained the minimum temperature needed, the electrical heating is discontinued and injection of drive fluid is started. This observed temperature profile then verifies the theoretical calculations, or indicates the nature and degree of erroneous assumptions. This information is then helpful in determining the correct predetermined time interval over which the electrical heating is carried out before the injection of a drive fluid is started.

While heating is continued, the bitumen is produced from the production well 13 by conventional techniques. For example, if it has been rendered mobile enough to flow readily, the pressure will be sufficient to cause production of the heated bitumen out of the production well 13 without requiring pumping facilities. On the other hand, with shallow overburdens, it may be economically feasible to install pumping equipment for pumping the bitumen from the production well 13. As illustrated, the pressure is employed to effect flow of the hot bitumen from the production well 13 and to the production facilities through surface conduit 45.

The heating, injectivity and production associated with the present invention continues until mobility of the bitumen in the formation occurs. Mobility is defined as the time at which the bitumen will sustain a minimum thoughput of at least 30 barrels per day. After mobility is achieved, then electrical heating is ceased and subsequent methods of production are employed, such as steam drive.

Thus, by proper patterning and employing the back pressures, immiscible fluids and initial preheating by use of electrical energy to mobilize the bitumen in the tar sand formation 15, the bitumen in a predetermined pattern can be separated from the sand grains in situ and the bitumen produced to the surface without requiring the handling of the large quantities of sand, as in surface mining technology. The surface mining technology is, as indicated, infeasible for most of subterranean tar sand formations of appreciable depths.

As implied hereinbefore, if the vapor pressure of the water in the formation reaches a point where it is equal to the back pressure held on the injection well, electrical power is interrupted and the wellbore pressure is lowered. Heated tar will be produced by pressure resulting from the thermal expansion of fluids and vaporization of water. In the event this course is followed, additional fluid should be injected and the cycle repeated.

It may be found necessary to withdraw some of the injected fluid in order to make room for additional thermal expansion of tar and water.

If a fluid of density greater than that of the bitumen is injected at the bottom of the pay zone, it will maintain electrical contact with the formation and only a minimal amount will be produced with the heated tar. As time passes, the heavy fluid should preferentially flow along the bottom of the pay zone to link wells quickly.

It may be desirable, in the event high pressures are realized and depressurizing must take place and additional fluid injected, to interrupt electrical power periodically to permit fluid production to relieve pressure. Alternatively, only enough fluid to establish electrical contact at the bottom of the pay zone could be injected. The upper portion of the heated region will be filled with steam but would be refilled with heated tar by thermal expansion.

An immiscible fluid, as the term is used herein, includes an aqueous solution of a strong electrolyte having high electrical conductivity. Water suitable for such aqueous solutions include dilute aqueous solutions, such as surface water, well water, rain water, city water, treated waste water and suitable oil field brines. By electrolyte is meant a strongly ionizing salt. A strong electrolyte is discussed and its requirements set forth at page 506 of OUTLINES OF PHYSICAL CHEMISTRY, Farrington Daniels, John Wylie and Sons, Inc., New York, 1948. Soluble inorganic salts are illustrative of salts which form strong electrolytes. The alkali metal halides typify such inorganic salts. Sodium chloride is the preferred salt for economic reasons. Calcium chloride may be employed if desired. Illustrative of other inorganic salts which form strong electrolytes is tetrasodiumpyrophosphate. Mixtures of salts may also be employed. Preferably an immiscible fluid having a density greater than that of the in place bitumen and water is injected into the tar sand formation.

It is realized that there may be some hazard when the heating and the injection of an electrolyte is carried out concurrently. The hazard of electrical shock is not insurmountable, however. Careful insulation and operation can prevent hazard to operating personnel and allow concurrent and simultaneous electrical heating and fluid injection to attain the desired mobility.

EXAMPLE

The following example is given to demonstrate a typical process carried out as described hereinbefore with respect to the FIGURE. The exemplified tar sand formation had an averaged thickness of 100 feet with an overburden of 1,000 feet in the pattern area. The tar sand formation had an averaged permeability of 700 millidarcies with the overburden and underburden being inpermeable shales. The tar sand formation had an averaged porosity of 0.33 with an initial bitumen saturation of 12 percent by weight, when averaged. The averaged electrical resistivity, in ohm-meters at 50°F, were, respectively:

| Tar Sand | Overburden | Underburden |
|---|---|---|
| horizontally 30<br>vertically 90 | 10 | 50 |

The geological formations adjacent the tar sand, as well as the tar sand formation 15, had an initial temperature of 50°F, an averaged thermal conductivity, in British Thermal Units per foot per hour per °F (BTU/ft/hr/°F) of 0.6, and an averaged thermal volumetric heat capacity in BTU per cubic foot per °F (BTU/ft$^3$/°F) of 44.

The exemplified pattern was a five-spot over 10 acres. The electrical heating time was 3 years, and the average electrical power input level for the pattern was 3,100 kilowatts. Thus, the total electrical input per pattern was 82 × 10$^6$ kilowatt hours (kwh). A back pressure of 700 psi was held on the injection well for the heating period. Six thousand gallons of 10 wt. percent NaCl brine were injected at the start of the heating period. The temperature adjacent the respective injection and production wells, equivalent to wells 11 and 13 in the FIGURE, was as follows:

Adjacent the respective wells, 466°F. The minimum temperature at the midpoint between the injection and production wells was 160°F to attain the desired mobility of the bitumen.

The bitumen had measured viscosities at different temperatures as follows:

50°F — 2 × 10$^6$ centipoises (cp)
160°F — 1,500 cp
466°F — 5.4 cp

The total pattern productivity during the heating period was 150 barrels per day.

While the injection of brine has been described hereinbefore, any other fluid that will have the desirable characteristics and convey the heat to the tar sand formation 15 may be employed. As a practical matter, a brine solution will be the fluid most commonly available in the field and have greatest feasibility because of its economy. Moreover, the hot aqueous fluids have a greater microscopic sweep efficiency for conveying heat to a greater overall portion of the tar sand formation. Hot fluids that are miscible with the bitumen in the tar sand formation are not employed if banking that comes with such miscible fluids requires intolerably high differential pressures to effect flow to the one or more production wells. Ordinarily, also, the miscible fluids have a lower heat capacity and are not as readily available as are the aqueous fluids. Hence, even though the miscible fluids will effect substantially 100 percent recovery on a microscopic sweep efficiency basis in the areas where they flood, they are, ordinarily, less feasible in recovering the bitumen from the tar sand formation.

From the foregoing descriptive matter, it can be seen that this invention provides a novel and unobvious way of producing bitumen from a tar sand formation that is feasible. This invention overcomes the disadvantages of the prior art processes which have been demonstrated to be inapplicable in recovering bitumen from the tar sand formations heretofore.

Having thus described the invention, it will be understood that such description has been given by way of illustration and example and not by way of limitation, reference for the latter purpose being had to the appended claims.

I claim:

1. A method of producing bitumen from a subterranean tar sand formation containing viscous bitumen while heating said formation via electrical conduction between a plurality of wells completed therein, which comprises the steps of:

a. maintaining a high back pressure on said wells,
b. injecting a fluid that is immiscible with said bitumen through at least one of said wells and into said tar sand formation, thereafter
c. interrupting electrical power transmission to said formation and releasing said pressure on said wells, and thereafter
d. producing said bitumen from at least one of said wells.

2. Method of claim 1 wherein said pressure is less than the amount that will fracture said formation but at least the amount necessary to inject said immiscible fluid.

3. Method of claim 2 wherein said pressure is from about 100 to about 2,000 psi.

4. Method of claim 1 wherein said immiscible fluid has a density greater than said bitumen.

5. Method of claim 4 wherein said immiscible fluid is injected at the bottom of said formation.

6. Method of claim 1 wherein said pressure is released when the vapor pressure of water in said formation equals said pressure held on said well.

7. Method of claim 1 wherein after said production of bitumen an additional amount of immiscible fluid is injected into said formation.

8. Method of claim 7 wherein said immiscible fluid is injected in no greater an amount than is necessary to establish electrical contact between said well and said formation.

9. Method of claim 7 wherein subsequent to said additional injection of immiscible fluid electrical power transmission to said formation is interrupted periodically to allow for production of a portion of said immiscible fluid.

* * * * *